US006006685A

United States Patent [19]

Kastrup et al.

[11] Patent Number: 6,006,685

[45] Date of Patent: Dec. 28, 1999

[54] BUTTONHOLE SEWING MACHINE HAVING A PLURALITY OF CUTTING BLOCKS

[75] Inventors: Eberhard Kastrup; Tobias Kaufhold, both of Bielefeld; Jochen Fischer, Detmold, all of Germany

[73] Assignee: Dürkopp Adler AG, Germany

[21] Appl. No.: 09/063,965

[22] Filed: Apr. 21, 1998

[30] Foreign Application Priority Data

Apr. 21, 1997 [DE] Germany ..... 197 16 629

[51] Int. Cl.[6] ..... D05B 3/08

[52] U.S. Cl. ..... 112/68; 112/130

[58] Field of Search ..... 112/68, 65, 67, 112/70, 129, 130, 475.25

[56] References Cited

U.S. PATENT DOCUMENTS 4,552,080 11/1985 Miyazaki ..... 112/68

5,085,157 2/1992 Jung et al. ..... 112/68

FOREIGN PATENT DOCUMENTS 291045 3/1914 Germany .

817993 10/1951 Germany .

3533022 3/1986 Germany .

*Primary Examiner*—Peter Nerbun

*Attorney, Agent, or Firm*—Ostrolenk, Faber, Gerb & Soffen, LLP

[57] ABSTRACT

A sewing machine having a machine arm, a rest for the material being sewn and a device for producing buttonholes, which comprises a cutting knife and a plurality of cutting blocks of respectively different lengths which are arranged on a common carrier. The buttonhole device is acted upon by an actuating device that can be moved from an upper position into a lower position, the cutting knife is arranged in a stationary manner underneath the sewing material, and the cutting block is lowered by the actuating device onto the cutting knife.

35 Claims, 4 Drawing Sheets

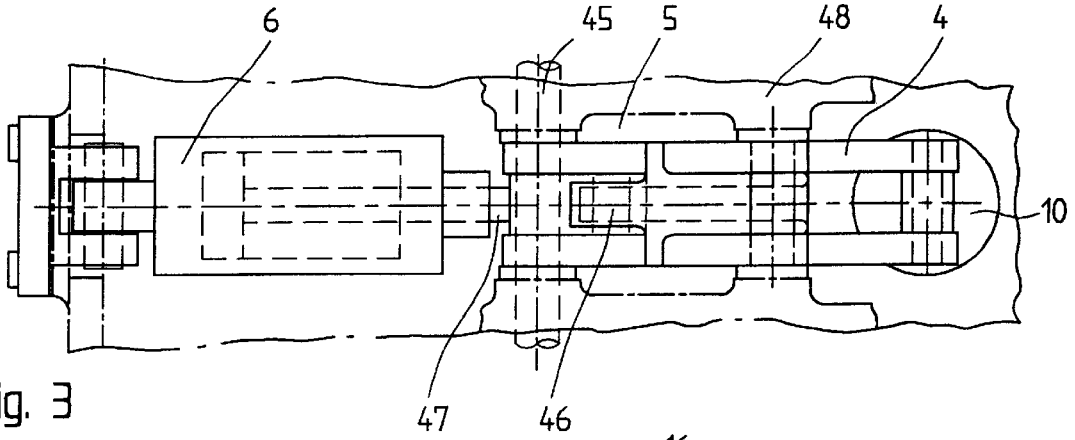
Fig. 3
Fig. 8
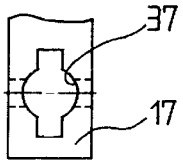
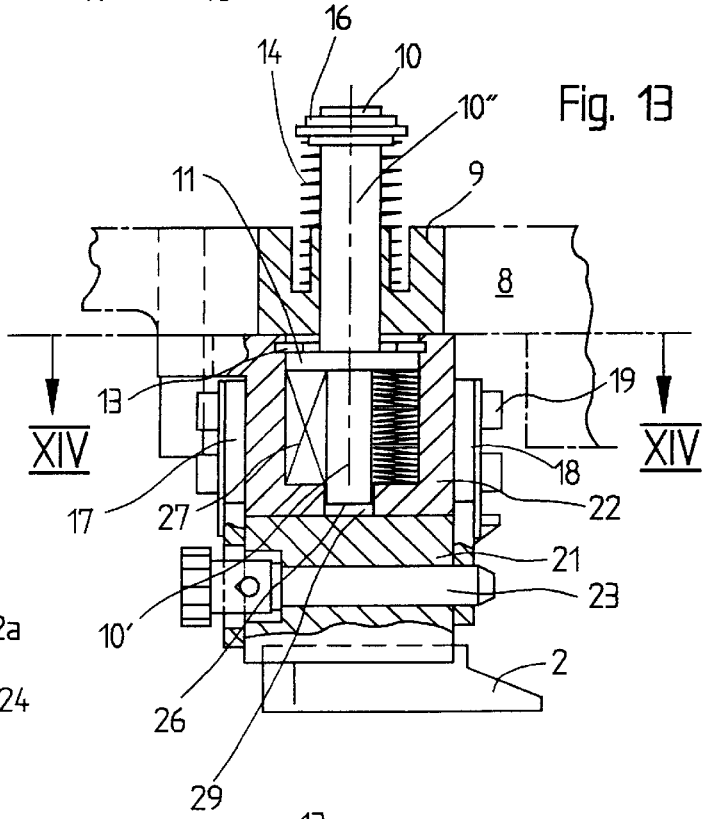
Fig. 13
Fig. 6
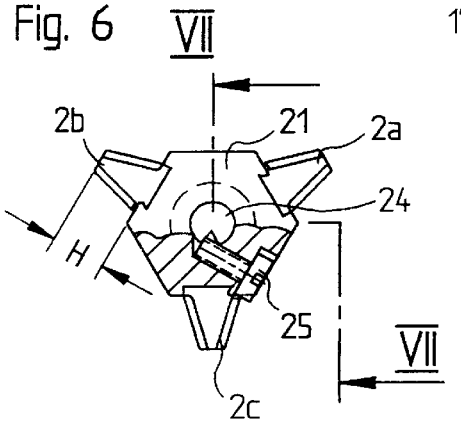
Fig. 9
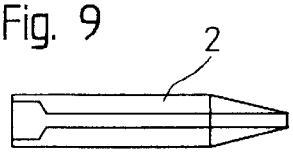
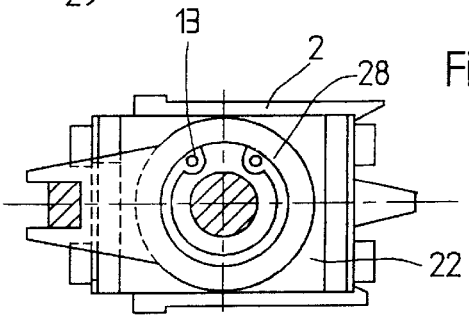
Fig. 14

BUTTONHOLE SEWING MACHINE HAVING A PLURALITY OF CUTTING BLOCKS

CROSS-REFERENCE TO RELATED APPLICATION

This is related to commonly-owned U.S. application Ser. No. 09/063,804, entitled TOLERANCE COMPENSATION DEVICE FOR A CUTTING DEVICE, filed on even date herewith, attorney docket P/2165-35, in which the named inventors are Michael Rosemann, Eberhard Kastrup and Jochen Fischer, the disclosures of which are incorporated by reference herein.

BACKGROUND OF THE INVENTION

The present invention relates to a sewing machine having a machine arm, a rest for the material being sewn and a device, which comprises a cutting knife and a cutting block, for producing buttonholes, especially eyelet buttonholes, in the material being sewn, the device being acted upon by an actuating device that can be moved from an upper position into a lower position, the cutting knife being arranged in a stationary manner underneath a stitch plate and the cutting block being able to be lowered onto the cutting knife.

Such a sewing machine is marketed by the Applicant under the description Dürkopp Adler Type 558, for example. Comparable sewing machines are disclosed by German Patent 291 045, German Patent 817 993 and German Offenlegungsschrift 35 33 022.

Such machines are basically provided for the purpose of using them to sew and to cut buttonholes of different lengths and shapes. In addition, the machines are able to operate in a pre-cutting mode and a post-cutting mode. In the pre-cutting mode, the buttonhole is cut before the buttonhole stitching is produced, and in the post-cutting mode the buttonhole stitching is produced (sewn) first and the buttonhole is then cut.

The cutting block and the cutting knife are always matched in the cutting unit, since over the duration of the operation the cutting knife cuts into the cutting block and thus leaves behind a depression which always has to be filled by the cutting knife in order to produce a clean and complete cut.

At the time of converting from the pre-cutting mode into the post-cutting mode, it is necessary not only for the knife to be offset in its position in the longitudinal direction, but also for the cutting block associated with this position to be inserted. Consequently, two cutting blocks are provided for each knife. Although they are of identical construction and are arranged at identical positions, they also have knife impressions that are positioned differently because of the different positioning of the knife. Conversion and adjustment consequently require a corresponding expenditure of time and effort.

In order to be able to sew in different modes, the sewing machine disclosed by DE 291 197 has a plurality of cutting knives which are provided in the baseplate, have different lengths and can be moved into engagement with a single cutting block. The reliable functioning of a machine configured in this way is only ensured when the cutting knives of different lengths are used regularly and interchangeably, so that none of the cutting knives—in particular not the shortest cutting knife—can dig more deeply into the cutting block than the others, with the result that each cutting knife finds its position in the cutting block again during the cutting. However, such a precondition is purely theoretical.

If a shorter knife digs more deeply into the cutting block than the longer knife or knives, it is not possible to make any proper incisions using the longer cutting knives.

SUMMARY OF THE INVENTION

It is therefore desirable to improve a sewing machine of the type described above in such a way that the cutting device can be matched or converted rapidly and simply between the pre-cutting or the post-cutting mode, and/or to make buttonholes of different lengths.

In order to accomplish this goal, the sewing machine may be provided with a plurality of cutting blocks, which advantageously have different respective lengths, and which are arranged on a common carrier.

As a result, cuts are made in each case using the same knife, but a different cutting block, whose length depends on the length of the buttonhole or the mode set. In this respect, the invention makes use of the discovery that the material being sewn can only be cut at that region where the cutting block and cutting knife engage each other. Consequently, the cutting knife may have any desired length, so long as the knife is longer than the longest cutting block or the longest buttonhole to be cut. In the region where the material being sewn rests on the knife without any pressure being exerted via the cutting block on the material being sewn, it is not possible for any incision to be produced.

The carrier is preferably detachably connected to the machine arm. By this means, the cutting blocks can be exchanged in a straightforward manner and, by detaching and reinserting the carrier into the machine, a different cutting block may be placed into use.

If the cutting blocks are fastened in the carrier along its perimeter and at a regular angular interval from each other, a different cutting block can be selected by removing the carrier and simply rotating it about its longitudinal axis, and then re-attaching it to the machine.

If the carrier is accommodated in a holder that can be lowered onto the cutting knife, it is possible for the holder to be mounted separately, with the result that a kinematic configuration becomes possible, according to which the holder executes only an exclusively vertical movement. Such a design ensures that the cutting block is always placed onto the knife completely flat and not, as is done in the prior art in the case of an arcuate lowering movement, first placed on the cutting knife with one edge and then rolled onto the cutting knife.

It is advantageous if the carrier can be connected to the holder via a quick-action closure, so that the carrier can be detached by hand and without tools. This reduces the conversion time considerably.

A particularly easy-to-handle design of the carrier is achieved if it is designed to be hexagonal in cross section and has three cutting blocks that are arranged in a regularly distributed manner and so that one face of the hexagon is free between each pair of them. Thus, the force that is necessary for the cutting operation can be applied via the face of the carrier which is located diametrically opposite the active cutting block.

The connection between the carrier and the holder can be made via a bolt or magnetically, for example.

If the carrier is provided with an encoder, which is preferably machine-readable, provision may be made for a device for reading an encoded carrier which detects which carrier (having which cutting blocks) is currently inserted into the machine and, via appropriate evaluation electronics in the controller of the sewing machine, it is possible for a comparison to be made as to whether the inserted carrier is also compatible with the sewing program that is about to be executed. By this means, waste and breakage are effectively avoided, since the situation is ruled out in which a carrier is inserted that is provided with cutting blocks which are not suitable for the sewing program.

The device for reading the encoded carrier preferably comprises a light transmitter, optical fibers and light-detecting sensors.

It is especially advantageous if the cutting knife or the cutting blocks are mounted resiliently.

For example, the holder which supports the cutting block carrier can be mounted so as to be movable in the vertical direction against the force of a spring. This permits the use of cutting blocks with different height dimensions in combination with an actuating device which follows a predefined movement sequence and applies a relatively high force in the lower position for cutting the buttonhole.

As a result of providing resiliency, the actuating device can move into its lower position and press the cutting block firmly onto the cutting knife in spite of any discrepancies in their height dimensions. If, following the contact between cutting block and cutting knife, the lever of the actuating device executes a further downward movement, either the cutting knife yields downward or the cutting block carries out a relative movement in relation to the actuating device. This design also offers the advantage that the cutting blocks can be exchanged individually or reworked individually on their operating surfaces if they are worn. A reworked cutting block has a lower height dimension than the other cutting blocks that have not been reworked. If the overlap in the vertical direction between the cutting knife and the cutting block includes the maximum tolerable wear of a cutting block, it is finally the case that neither of the components yields, whereas in the case of cutting blocks having a greater height dimension, a yielding movement continues to take place.

It is preferable if the holder can be moved in the vertical direction, counter to the force of at least one spring, when the actuating device has reached its lower position.

This can preferably be implemented when the holder accommodates, in its interior, one end of a pin which is guided in a fixed bearing and the other end of the pin is acted upon by the actuating device, and at least one spring is arranged between the pin and the holder, a relative movement takes place between the pin and the holder, and the bearing being provided between the holder and the actuating device.

In order to fix the holder in the bearing in a straightforward way in the upper position, the pin may be loaded by a compression spring that is supported on the bearing. The spring force counter to which the holder can be moved relatively is preferably applied by a spring assembly. The possible relative movement is less than 1 mm, preferably only a few tenths of a millimeter.

Other features and advantages of the present invention will become apparent from the following description of embodiments of the invention which refers to the accompanying drawings.

BRIEF DESCRIPTION OF THE DRAWINGS

FIG. 3 is a partial plan view of the sewing machine taken according to arrow III in FIG. 1;

FIG. 6 is a partial view taken according to arrow VI in FIG. 4;

FIG. 8 is a partial view taken according to arrow VIII in FIG. 4;

FIG. 9 is a view of a cutting block taken according to arrow IX in FIG. 4;

FIG. 13 is a longitudinal cross-section showing additional details of the cutting block;

FIG. 14 is a cross-section taken along the line XIV—XIV in FIG. 13;

DETAILED DESCRIPTION OF EMBODIMENTS OF THE INVENTION

Figure 1:
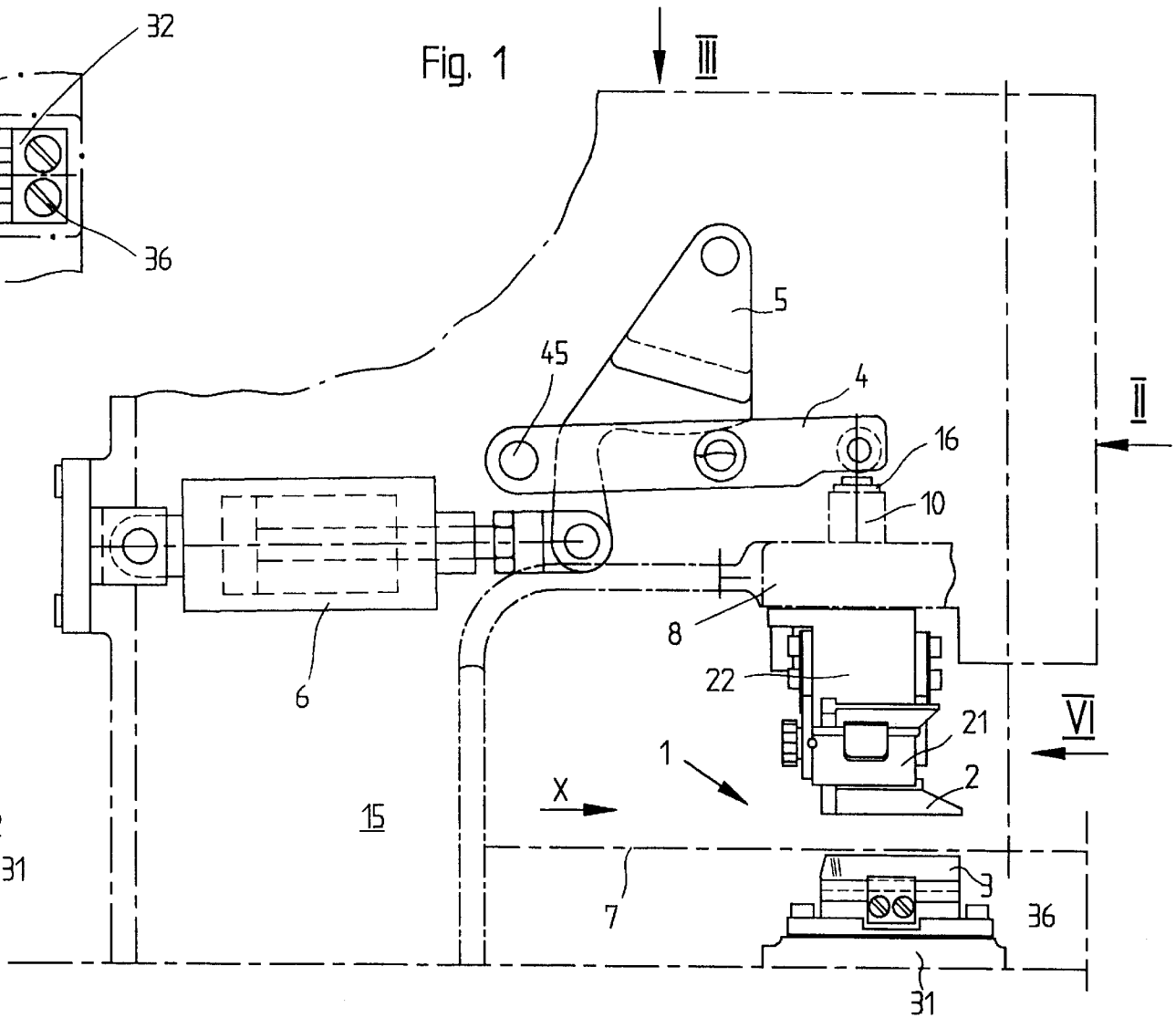
FIG. 1 is a partial front view of an eyelet buttonhole sewing machine, in a partly simplified illustration.
Figure 12:
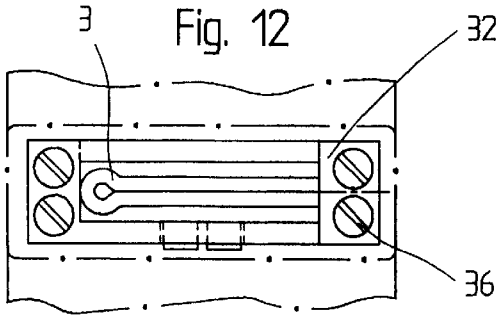
FIG. 12 is a view taken according to arrow XII in FIG. 11.

As shown in FIG. 1, an eyelet buttonhole sewing machine is provided with a device 1 for cutting the buttonholes. This device comprises a cutting block assembly 2 and a cutting knife 3. Via an actuating device, which comprises levers 4, 5 and a pneumatic cylinder 6 connected thereto, the cutting block assembly 2 can be lowered onto the cutting knife 3 from its upper position (illustrated in the figure) into its lower position. In the process, the buttonhole is cut into the sewing material that is resting on the plane designated by 7. The stitch plate, which is not illustrated specifically here, is, for example, also located in this plane 7. The arrangement of the levers 4, 5 and the mounting of the cutting device 1 are selected such that the cutting block assembly 2 moves toward the cutting knife 3 in the vertical direction in a rectilinear movement.

Figure 16:
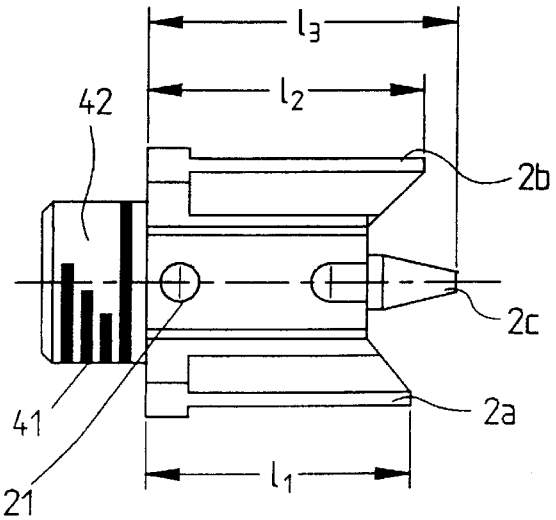
FIG. 16 shows a cross-section taken along the line XVI—XVI in FIG. 15.

Referring now to FIGS. 6 and 16, for example, in order to be able to implement different buttonhole lengths, three cutting blocks 2*a*, 2*b*, 2*c*, which each have a different length $l_1$, $l_2$, $l_3$ (X direction), are provided on the cutting block assembly 2 in the sewing machine. By using the cutting block 2*a*, 2*b*, 2*c* of appropriate selected length, the incision in the material being sewn is effected only in the region where the cutting block comes into contact with the cutting knife 3. In the region where the material being sewn rests on the cutting knife 3 in a manner projecting beyond the cutting block, it is not possible to cut into the material.

The three cutting blocks 2*a*, 2*b*, 2*c*, which are provided on the cutting block assembly 2, are arranged on a carrier 21 of hexagonal cross-section (FIG. 6), a free side face of the hexagon remaining between each two cutting blocks. As FIG. 6 shows, each cutting block is fixed in the carrier 21 via at least one screw 25. This carrier 21 is connected to a holder 22 via a quick-action closure in such a way that the carrier 21 can be removed manually from the holder 22 without a tool having to be used. As a result of this design, the machine can be converted in a straightforward manner to other buttonhole lengths or cutting modes, by the operator detaching the carrier 21 from the holder 22, rotating the carrier such that the cutting block of desired length is turned towards the cutting knife 3, and then connecting the carrier 21 to the holder 22 again.

As FIG. 13 shows, this connection may be performed via a bolt 23, which can be latched into a correspondingly designed bore 24 in the carrier 21 (FIG. 6). In order to fasten the carrier 21 to the holder 22, carrier plates 17, 18 are provided on both sides of the holder 22 and are screwed to the same via screws 19, although they can be displaced to a limited extent. One carrier plate 18 is provided with a through-hole in the lower region. The other carrier plate 17 is provided, coaxially with this through-hole, with a slotted hole 37 (FIG. 8). The bolt 23 has a pin that is arranged transversely with respect to its longitudinal axis. As a result of the bolt 23 being inserted into the slotted hole 37 and rotated through 90°, the pin engages behind the carrier plate 17, and the bolt 23 is secured against falling out.

The quick-action connection can also be produced by the carrier 21 being connected magnetically to the holder 22 by an electromagnet (not illustrated specifically here) which is accommodated, for example, in the holder 22 and attracts the carrier 21, which is constructed from ferromagnetic material.

It is important for the carrier 21 to be guided and centered by appropriate structures in order to assume a defined position in relation to the holder 22, to ensure reliable cutting of a buttonhole with each cutting block.

Figure 15:
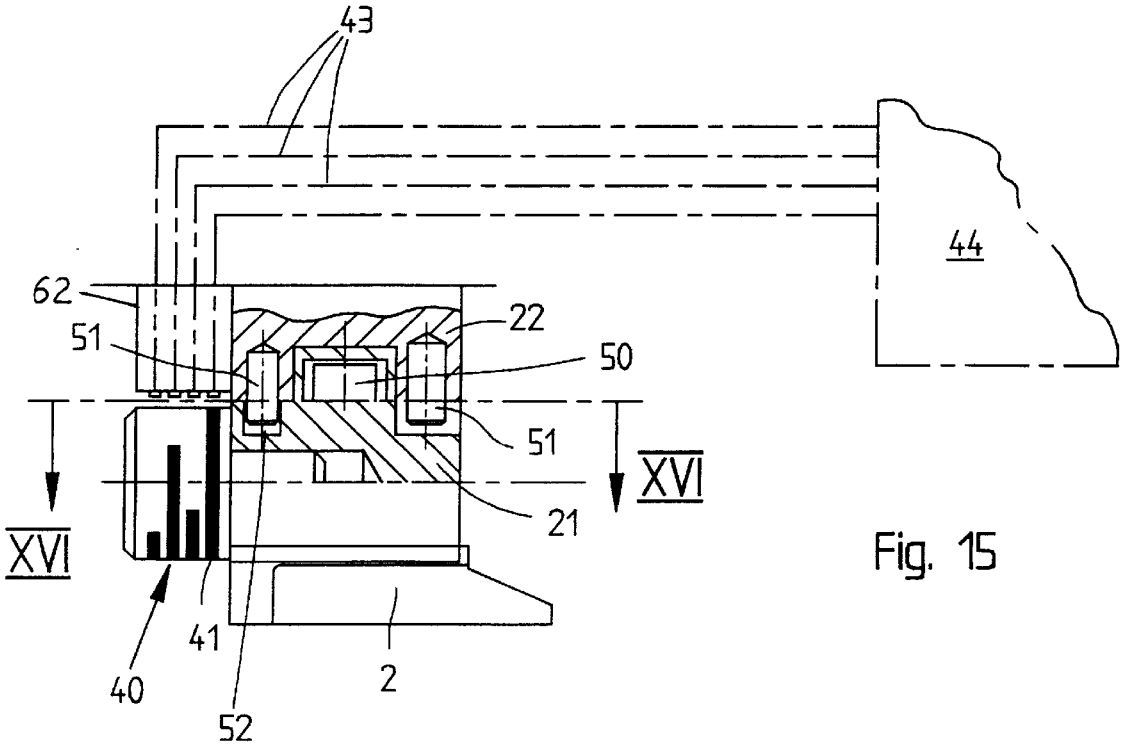
FIG. 15 shows an exemplary embodiment of an encoder for the cutting block.

As illustrated in FIG. 15, however, it is also possible to employ a simple magnetic fastening, wherein a permanent magnet 50 is mounted in the holder 22 and, in addition, pins 51, which project downward beyond the holder 22, are provided alongside the permanent magnet 50. By means of holes 52 in the carrier 21 that correspond to the pins 51, the carrier is centered in relation to the machine and to the holder 22, is secured against twisting and fixed via the permanent magnet 50.

Figure 11:
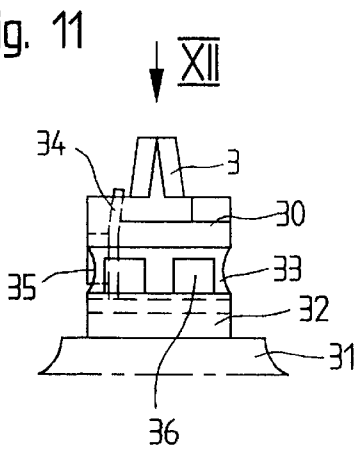
FIG. 11 is a view taken according to arrow XI in FIG. 10.
Figure 10:
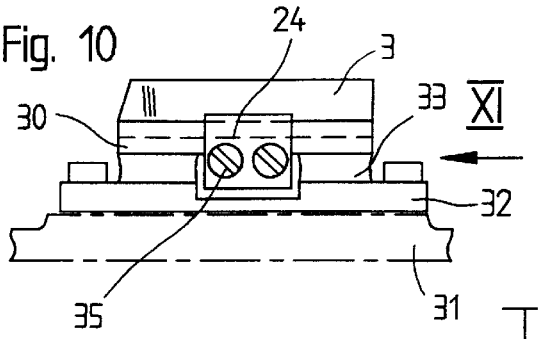
FIG. 10 is a detail view showing the cutting knife of FIG. 1 on an enlarged scale.
Figure 4:
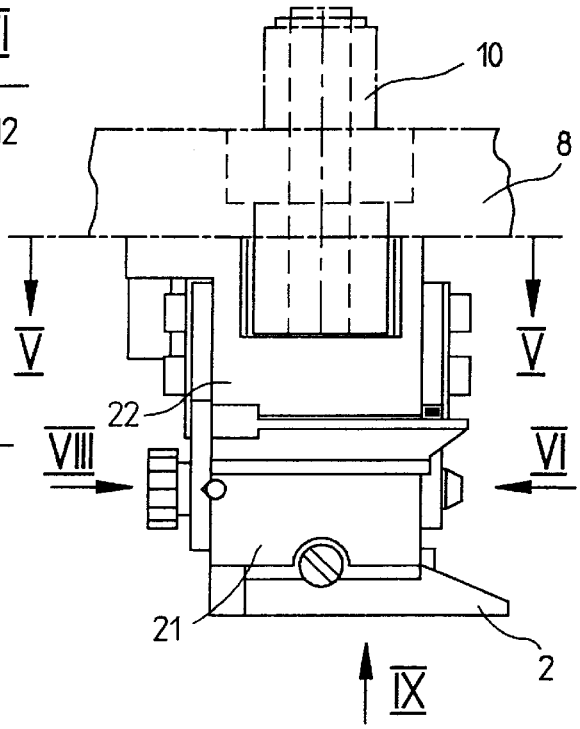
FIG. 4 is a detail view showing the cutting block of FIG. 1 on an enlarged scale.
Figure 2:
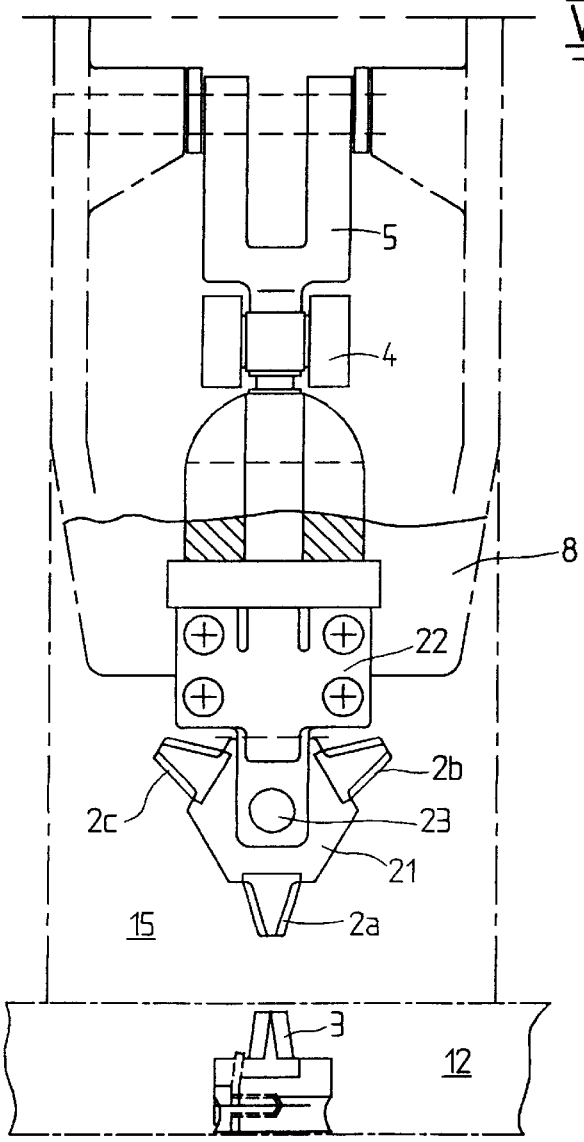
FIG. 2 is a view taken according to arrow II in FIG. 1.
Figure 7:
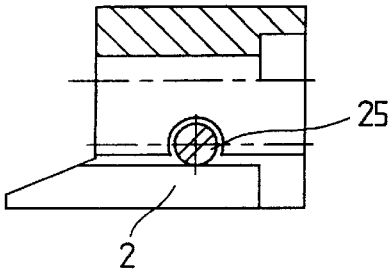
FIG. 7 is a cross-section taken along the line VII—VII in FIG. 6.
Figure 5:
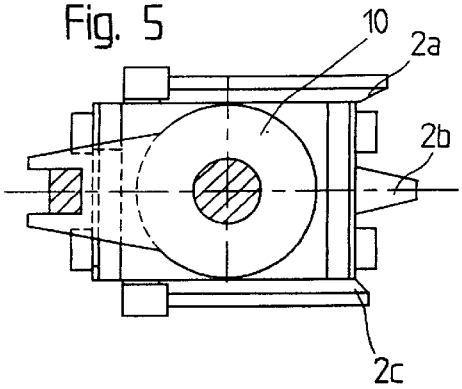
FIG. 5 is a cross-section taken along the line V—V in FIG. 4.

FIG. 11 illustrates that underneath the stitch plate (plane 7), which is not illustrated specifically here, the cutting knife 3 is fixed in a knife holder 30, which in turn is screwed to the knife bearing 31 via a plate 32. In order to be able to compensate in a simple manner for tolerances which may result, during buttonhole cutting, from different height dimensions H of the individual cutting blocks 2*a*, 2*b*, 2*c* (FIG. 6), it is possible for the cutting knife 3 to be mounted on a rubber block 33 of suitable Shore hardness. To this end, as FIG. 10 shows, the rubber block 33 is arranged between a knife holder 30, which accommodates the cutting knife 3, and the plate 32. The knife holder 30, the rubber block 33 and the plate 32 are combined to form one component in a vulcanizing operation. As an alternative, this connection of the parts can also be achieved by adhesive bonding. The cutting knife 3 is fixed to the knife holder 30 via at least one clamping plate 34 using two screws 35.

The device for compensating for tolerances between the cutting blocks and the cutting knife 3 offers the advantage that each cutting block 2*a*, 2*b*, 2*c* can be individually reworked or exchanged and it is not necessary to rework or exchange all the cutting blocks together, should reworking or exchange become necessary as a result of wear of one of the cutting blocks 2*a*, 2*b*, 2*c*. The effect of the tolerance compensation device is that the cutting block is moved, via the actuating device or the pin 10, into its lower position, in which the lever drive is in a defined end position, and in this position either the cutting knife 3 can yield downward or the cutting block 2—as is to be described in yet more detail below—can yield upward, in order to avoid mechanical overloading, or even destruction, of the components. This possible yielding movement in the vertical direction is restricted in practice to less than 1 mm, usually to a few tenths of a millimeter.

In order to allow a relative movement of the cutting block in the vertical direction, the holder 22 is mounted such that it can move with respect to the pin 10, via which the downward movement of the actuating device is initiated by way of the levers 4, 5. As shown in FIGS. 13 and 14, in a recess 28, the pin 10 is provided with an attachment 11 that broadens the pin and whose outer diameter corresponds approximately to the diameter of the recess 28. Inserted into the recess 28 is a pre-stressed spring assembly 27, which is supported against the bottom of the recess 28 on one side and against the attachment 11 on the other side. The lower end 10' of the pin 10 projects into a hole 29 that is concentric with the recess 28, but ends before the end of the holder 22, with the result that, as FIG. 13 shows, a clearance 26 remains between the lower end 10' of the pin 10 and the carrier 21, the height of the clearance gap defining the maximum possible relative movement of the cutting block. The pin 10 is fixed in the holder 22 via a securing ring 13, which is provided on that side of the attachment 11 which is located opposite the spring assembly 27. The upper end 10" of the pin 10 is guided in a sliding bearing bush 9 in a bearing 8 that is connected to the sewing-machine arm 15 (not shown). The unit comprising the cutting block, cutting-block carrier 21 and holder 22 is fixed in its upper position via a pre-stressed compression spring 14, which is supported in the siding bearing bush 9 and is connected to the pin 10 via a securing ring 16. The compression spring 14 serves at the same time as a return spring.

In viewing FIGS. 1 and 13, when the piston rod of the pneumatic cylinder 6 moves out, the lever 4 pivots downward, as a result of which the latter presses the pin 10 downward counter to the force of the compression spring 14 and moves the cutting block toward the cutting knife 3. The displaceability of the carrier plates 17, 18 makes it possible for the face of the carrier 21 located diametrically opposite the active cutting block to come into contact over its entire extent with the holder 22, and hence optimum transmission of force is achieved. If the cutting block comes into contact with the cutting knife 3 before the lever 4 has reached its lower position, the reaction force presses the holder 22 counter to the force of the spring assembly 27, with the result that the holder moves in relation to the pin 10 until the lever 4 has reached its lower position.

In order to ensure that a carrier 21 having the correctly selected cutting blocks 2*a*, 2*b*, and 2*c* (combination of the correct lengths $l_1$, $l_2$, $l_3$) is used for the respective operation, the carrier 21 is provided with an encoder 40, as FIGS. 15 and 16 show. This encoder 40 comprises individual light-reflective conductors 41 which are fitted over a specific length in an attachment 42 in the carrier 21. Provided in a fixed position on the machine is an optical-fiber holder 62, in which individual optical fibers 43 (for example glass fiber cables) are accommodated. By optical scanning of the inserted carrier 21, it is possible to check, via appropriate evaluation electronics in the controller 44 of the sewing machine, whether the inserted carrier 21 matches the sewing program currently selected.

The encoder 40 illustrated in FIGS. 15 and 16 is equipped with four of the conductors 41, which results in $2^4=16$ encoding possibilities. It is thus possible, for example, to detect 15 cutting blocks 2*a*, 2*b*, 2*c* that are arranged on different carriers 21 and to output appropriate signals, and a further signal in the absence of an inserted carrier 21, to the controller 44.

Although the present invention has been described in relation to particular embodiments thereof, many other variations and modifications and other uses will become apparent to those skilled in the art. Therefore, the present invention is not limited by the specific disclosure herein.

What is claimed is:

1. A sewing machine comprising:

a machine arm;

a resting plane for a sewing material being sewn; and a device for producing buttonholes in the material, said device for producing buttonholes comprising:

a cutting knife which is arranged in a stationary manner with respect to the sewing material rest;

a plurality of cutting blocks of different respective lengths which are arranged on a carrier; and an actuating device;

wherein the cutting block carrier is movable by the actuating device between an upper disengaged position and a lower position in which one of said cutting blocks engages the cutting knife.

2. The sewing machine as claimed in claim 1, wherein the carrier is detachably connected to the machine arm.

3. The sewing machine as claimed in claim 2, wherein the cutting blocks are fastened on the carrier along a perimeter thereof and at a regular angular interval from each other.

4. The sewing machine as claimed in claim 1, wherein the cutting blocks are fastened on the carrier along a perimeter thereof and at a regular angular interval from each other.

5. The sewing machine as claimed in claim 1, wherein the carrier is accommodated on a holder that is configured for movement by the actuating device.

6. The sewing machine as claimed in claim 2, wherein the carrier is accommodated on a holder that is configured for movement by the actuating device.

7. The sewing machine as claimed in claim 3, wherein the carrier is accommodated on a holder that is configured for movement by the actuating device.

8. The sewing machine as claimed in claim 4, wherein the carrier is accommodated on a holder that is configured for movement by the actuating device.

9. The sewing machine as claimed in claim 5, wherein the holder executes an exclusively vertical movement.

10. The sewing machine as claimed in claim 6, wherein the holder executes an exclusively vertical movement.

11. The sewing machine as claimed in claim 7, wherein the holder executes an exclusively vertical movement.

12. The sewing machine as claimed in claim 8, wherein the holder executes an exclusively vertical movement.

13. The sewing machine as claimed in claim 2, wherein the carrier is detachably connected to the machine arm by a holder via a quick-action closure, wherein the carrier is configured for detachment from the holder by hand and without tools.

14. The sewing machine as claimed in claim 13, wherein the quick-action closure comprises a bolt.

15. The sewing machine as claimed in claim 13, wherein the quick-action closure comprises a magnetic fastener.

16. The sewing machine as claimed in claim 1, wherein the carrier is provided with an encoder.

17. The sewing machine as claimed in claim 16, wherein the encoder is machine-readable.

18. The sewing machine as claimed in claim 2, wherein the carrier is provided with an encoder.

19. The sewing machine as claimed in claim 18, wherein the encoder is machine-readable.

20. The sewing machine as claimed in claim 1, further comprising a reading device on the machine arm for reading an encoder on a carrier.

21. The sewing machine as claimed in claim 20, wherein the reading device has optical fibers for conducting light reflected from the encoder.

22. The sewing machine as claimed in claim 1, wherein at least one of the cutting knife and the cutting block carrier is mounted resiliently in order to compensate for tolerances in the height dimension of the cutting blocks.

23. The sewing machine as claimed in claim 22, wherein a fixed bearing is provided between a holder and the actuating device, a pin is provided wherein one end of the pin is guided into the fixed bearing and the other end of the pin is acted upon by the actuating device, at least one spring is arranged between the pin and the holder, whereby the pin and the holder are configured for relative movement.

24. The sewing machine as claimed in claim 23, wherein said spring is a compression spring that is supported on the bearing.

25. The sewing machine as claimed in claim 23, wherein the holder is movable in the vertical direction, counter to the force of said at least one spring, when the actuating device has reached a lower position thereof.

26. The sewing machine as claimed in claim 25, wherein said spring is a compression spring that is supported on the bearing.

27. The sewing machine as claimed in claim 23, wherein said spring is arranged in the interior of the holder.

28. The sewing machine as claimed in claim 24, wherein said spring is arranged in the interior of the holder.

29. The sewing machine as claimed in claim 25, wherein said spring is arranged in the interior of the holder.

30. The sewing machine as claimed in claim 26, wherein said spring is arranged in the interior of the holder.

31. The sewing machine as claimed in claim 23, wherein said relative movement is less than 1 mm.

32. The sewing machine as claimed in claim 1, wherein the carrier is hexagonal in cross-section and has three cutting blocks that are arranged thereon regularly distributed about a perimeter of the carrier.

33. The sewing machine as claimed in claim 32, wherein said actuating device engages a face of said carrier which is diametrically opposite to one of said cutting blocks.

34. The sewing machine as claimed in claim 2, wherein the carrier is hexagonal in cross-section and has three cutting blocks that are arranged thereon regularly distributed about the perimeter of the carrier.

35. The sewing machine as claimed in claim 34, wherein said actuating device engages a face of said carrier which is diametrically opposite to one of said cutting blocks.

* * * * *